US005216760A

United States Patent [19]

Brown et al.

[11] Patent Number: 5,216,760

[45] Date of Patent: Jun. 8, 1993

[54] SPLASH AND OVERSPRAY GUARD

[76] Inventors: J. Devon Brown, 5332 Angelina Ave., Carmichael, Calif. 95608; Dennis Hollenberg, 2605 D St, #2, Sacramento, Calif. 95816

[21] Appl. No.: 882,917

[22] Filed: May 14, 1992

[51] Int. Cl.[5] ..... A47K 13/08

[52] U.S. Cl. ..... 4/300.3; 4/DIG. 18; 4/658; 4/245.004

[58] Field of Search ..... 4/300.3, 658, DIG. 18, 4/245.1, 245.3, 245.4, 245.5, 245.6, 245.7, 245.8, 245.9, 655, 656, 658, 665, 515, 516, 519, 520

[56] References Cited

U.S. PATENT DOCUMENTS

| | | | |
|---|---|---|---|
| 1,673,622 | 6/1928 | Engalitcheff | 4/245.9 |
| 2,817,851 | 12/1957 | Barnwell | 4/DIG. 18 |
| 2,980,919 | 4/1961 | Otto et al. | 4/300.3 |
| 3,071,778 | 1/1963 | Renshaw | 4/300.3 |
| 3,914,803 | 10/1975 | Gregovski | 4/1 |
| 3,931,649 | 1/1976 | Jankowski | 4/1 |
| 4,010,497 | 3/1977 | Menter et al. | 4/1 |
| 4,060,859 | 12/1977 | Anderson | 4/102 |
| 4,348,776 | 9/1982 | Sarjeant | 4/300.3 |
| 4,722,103 | 2/1988 | Kiebert | 4/658 |
| 4,912,784 | 4/1990 | Jacobson et al. | 4/300.3 |
| 4,975,990 | 12/1990 | Chan | 4/243 |
| 5,067,185 | 11/1991 | kohler | 4/DIG. 18 |

FOREIGN PATENT DOCUMENTS

| | | | |
|---|---|---|---|
| 349468 | 1/1990 | European Pat. Off. | 4/245.9 |

*Primary Examiner*—Henery J. Recla
*Assistant Examiner*—Charles R. Eloshway

[57] ABSTRACT

A portable splash and overspray guard has a substantially oval shape and includes a surrounding wall structure for catching and transporting accumulated waste fluids. The splash and overspray guard may be adhesively attached to a toilet seat for use with a toilet.

5 Claims, 3 Drawing Sheets

Fig. 1
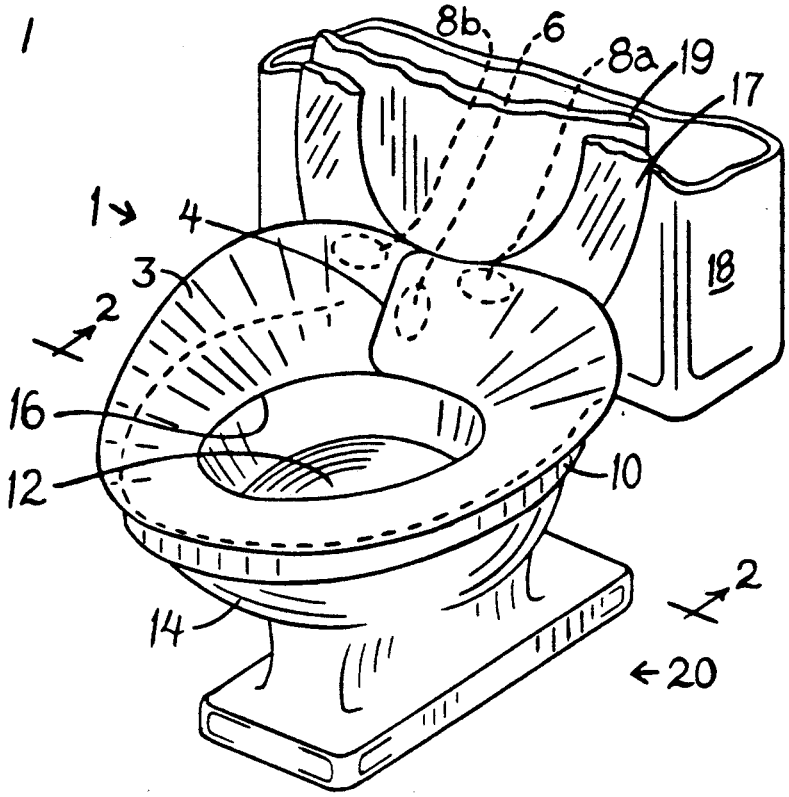
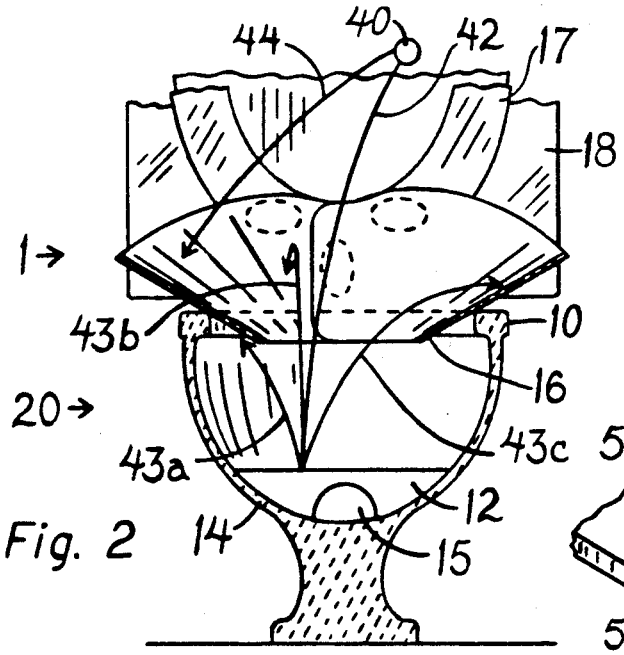
Fig. 2
Fig. 3
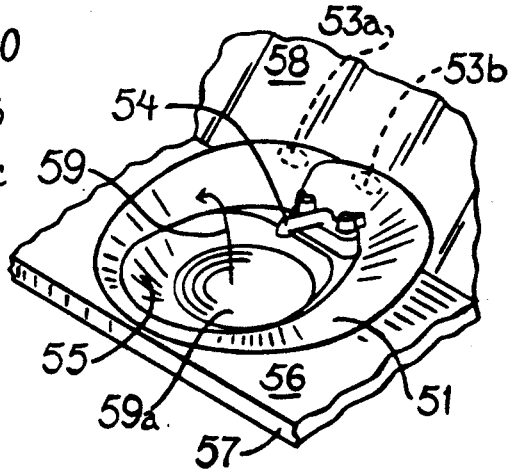

SPLASH AND OVERSPRAY GUARD

BACKGROUND OF THE INVENTION

This invention relates generally to guards for protecting surfaces adjacent to a water fixture from splashes and overspray generated in conjunction with the fixture's use. More specifically, the invention relates to splash and overspray guards for water basins and toilet bowls.

The use of water basins and toilets inevitably results in the accumulation of splashed liquid and other foreign material contaminating surfaces adjacent to the fixtures. Often these liquids contain agents and chemical residues which are harmful to those surfaces. The residues also represent a potential hygienic hazard in that they could provide a means for transmitting disease. Finally, such residues are unsightly and aesthetically objectionable.

Additionally, liquids associated with bathroom fixtures often contain chemicals and agents which may damage adjacent surfaces. For example, male juveniles and physically impaired persons can sometimes misdirect their urine so that it falls outside the toilet bowl confines. This overspray results in a pervading and disagreeable odor. The geometry of some parts of fixtures, particularly toilets, make access for cleaning difficult. For example, the area of the toilet around the toilet-seat hinge tends to accumulate unsightly bodily debris. Even when clean bathroom fixtures are uniformly aesthetically unappealing.

These problems can cause tangible losses. When traveling, for example, whether on commercial airplanes, buses, or trains, passengers are subject to emotional stress. When in the course of their trip they desire to use bathroom facilities, passengers have no alternative to those on board the vehicle. If the onboard facilities are not frequently cleaned, residue and splashed liquids accumulate on countertops and around toilet fixtures. Forced to function in such degenerate conditions, passengers often react negatively and their stress level is thereby increased. This heightened stress might then cause them to seek alternative carriers or transportation means. In extreme cases they might choose to not travel. Commercial transportation companies may then lose passengers which, in turn, causes reduced revenues.

It is therefore desirable that residue and splashed liquids, be confined to the bathroom fixture's basin or bowl and be prevented from accumulating on adjacent surfaces. It is also desirable to provide agreeable aromas to the bathroom area. Finally, it is desirable to provide interesting and aesthetically appealing designs to the bathroom area.

Other inventions have addressed these obvious problems. Menter et al (U.S. Pat. No. 4,010,497) show a paper splash guard which floats in the toilet bowl but which doesn't guard against toilet overspray or wash-basin splashing. Kliebert (U.S. Pat. No. 4,722,103) shows a splash guard which shields background objects from wash-basin splashing but it fails to protect lateral-foreground surfaces and cannot be used for toilets. Jacobson et al (U.S. Pat. No. 4,912,784) shows a toilet splash guard which similarly fails to protect lateral and foreground surfaces from splashing. Jankowski (U.S. Pat. No. 3,931,649), Anderson (U.S. Pat. No. 4,060,859), Sarjeant (U.S. Pat. No. 4,348,776), and Gregovski (U.S. Pat. No. 3,914,803) show splash guards which are attached to toilets and either retract or collapse out of the way in the event the toilet seat is lowered. However, these inventions introduce additional complex surfaces which must themselves be cleaned, thereby complicating the cleaning task. They are also relatively expensive, difficult to install properly, awkward appearing, and would tend to become increasingly unattractive as their surfaces deteriorate with age and use. Additionally, Gregovski shows a splash shield with lateral panels which have no provision for sealing the space between the exterior of the toilet bowl and each lateral panel; it appears, therefore, that urine overspray would leak from the shield surfaces onto the floor. Finally, Chan (U.S. Pat. No. 4,950,990) shows a combination splash suppressor and toilet-seat cover which becomes wet when placed in position and appears awkward to use.

OBJECTS AND ADVANTAGES

Accordingly, it is an object of subject invention to provide a splash guard which provides a baffle projecting relatively inwardly to the toilet-bowl interior to prevent fluid toilet-bowl ejecta having a relatively low angle of trajectory, and, therefore, able to traverse a relatively great distance from the toilet, from splashing out onto adjacent surfaces. A second object of this invention is to provide a guard to prevent falling fluid ejecta and misdirected urine overspray from landing on surfaces adjacent to toilet and wash-basin surfaces. A third object of this invention is to provide a method for easily fabricating a three-dimensional splash shield from semirigid, two dimensional materials including paper and plastic. A fourth object of this invention is to provide a three-dimensional splash guard having a maximum annular-limb width, i.e., the diameter of the splash guard minus the center hole and that result divided by 2, of D dimension from lengthy two-dimensional stock having a constant width of D dimension. A fifth object of this invention is to provide a splash guard which can be used for toilets and wash basins. A sixth object of this invention is to provide a toilet splash guard which deformably and resiliently remains in place when the toilet seat is lowered for use and then returns to its intended configuration for service when the toilet seat is again raised. A seventh object of this invention is to provide a splash guard which may also be used as a toilet-seat cover. An eighth object of this invention is to provide a splash guard which extends exteriorly beyond the outer perimeter of the toilet bowl rim to catch overspray. A ninth object of this invention is to provide a splash guard which can be easily and stably put into place for use. A tenth object of this invention is to provide a splash guard which can be scented with aromatic materials which may be released by contact with fluids associated with its use. An eleventh object of this invention is to provide a splash guard which can be decorated to provide aesthetic pleasure and intellectual stimulation in concert with its use.

SUMMARY OF THE INVENTION

In accordance with subject invention, a one-piece splash and overspray guard is provided which is comprised of an annulus or ring shape, the outer edges of which project outwardly beyond the outer rim of a liquid-containing fixture, such as a toilet bowl, toilet seat or wash basin, to catch and redirect liquid splashes generated in the process of its use. Means interior to the basin or bowl is provided to stop or baffle splashes arising from the basin or bowl liquid which might otherwise escape the basin or bowl. Means is also provided to fabricate this three-dimensional shaped splash and overspray guard from flat or two dimensional semirigid sheet material such that the resulting form approximates a structurally stable, truncated hollow cone or funnel shape. Means is also provided to form blanks, from which many splash and overspray guards can be fabricated, from long, narrow material, the width of which is substantially that of the maximum annular web width, by forming periodically joined pleats along the interior edge portion of the blank or manufacturing blanks from puckered material. Means is also provided to form a splash and overspray guard which is molded from materials which may then be cleaned for reuse.

One embodiment of subject invention is fabricated from a generally U-shaped blank of flat material. The free ends of said blank are then fastened in a generally overlapping manner which causes the two-dimensional blank to assume a shallow, substantially three-dimensional shape like that of a cone and having a generally central hole. Placed in a position generally on the rim surrounding a bowl or basin of liquid, the splash and overspray guard is generally fixed in position by a low-tack adhesive located on the back surface of said guard. In another embodiment of the invention, a generally U-shaped blank is produced from long, narrow material by pleating one side of said material and joining certain adjacent pairs of pleats, which are selected on a periodic basis with the intention being that the resulting shape be appropriately U-shaped. This process results in a splash and overspray guard having a generally pleated texture. In another embodiment of the invention a molded splash and overspray guard is formed which provides an exterior trough to catch misdirected urine and which may subsequently be cleaned for reuse.

BRIEF DESCRIPTION OF THE DRAWINGS

FIG. 1 is a perspective view of a splash and overspray guard in position for use on a toilet.

FIG. 2 is a cross-sectional elevation view of a splash and overspray guard positioned on a toilet for use.

FIG. 3 is a perspective view of a splash and overspray guard in position for use on a wash basin.

DESCRIPTION AND OPERATION

Figure 4:
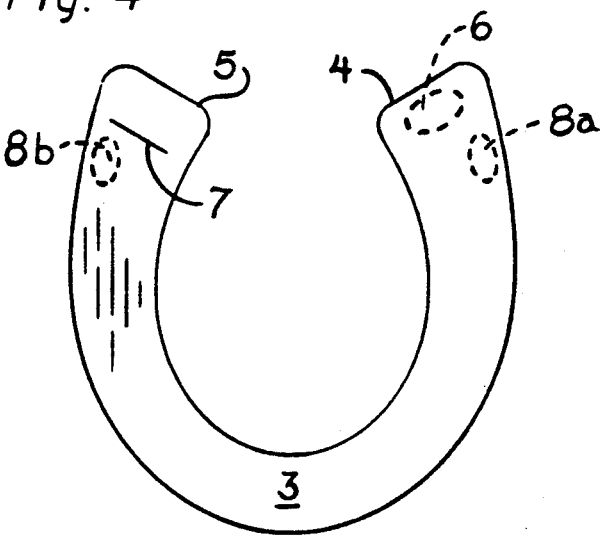
FIG. 4 is a plan view of the U-shaped blank from which a splash and overspray guard is fabricated for use.

Referring now descriptively to the drawings in which similar reference characters denote similar elements throughout the several views, the several figures are addressed. FIG. 1 is a perspective view of the invention in which can be seen the splash and overspray guard 1, section viewpoint 2, consisting of substantially flat blank 3 which is fabricated by connecting overlap 4 to the underlapping opposite end of said blank by adhesive 6 on underside of said overlap by substantially aligning said overlap on a guide mark located on said underlap such that said guard assumes a shallow cone shape, including an inner, baffle 16. Said guard is then positioned on rim 10 of toilet fixture 20 and substantially temporarily secured by means of low-tack adhesive 8*a* and 8*b*, located on the underside of said overlap and said underlap, respectively, which substantially temporarily adhere to the underside of seat 17 for toilet use when the seat is up to prevent liquids, including urine and liquid from pool 12, substantially confined by bowl 14, from accumulating on adjacent surfaces including said rim, said seat, and lid 19, leaning against toilet tank 18. Alternatively, said guard may be positioned upon the top side of said seat for use as a covering in which case said low-tack adhesives are attached to the underside of said lid which is positioned substantially vertically.

Referring now to FIG. 2 in which a cross-sectional view of the splash and overspray guard 1 shown in FIG. 1 in position for use on a toilet fixture 20, which said fixture consists of rim 10, liquid pool 12, bowl 14, bowl drain 15, seat 17, and toilet tank 18 wherein exemplary human urine source 40 introduces accurately directed urine stream 42 into said pool which causes exemplary splashes including left splash 43*a*, center splash 43*b*, and right splash 43*c* the trajectory or direction of movement of each of which can be seen to be, respectively, directed towards escaping said rim but prevented by baffle 16 which is the inner portion of said guard, directed towards said seat area but caught by said guard, and directed over said rim but also caught by said guard. In addition, the exemplary direction of flow of misdirected urine stream 44 is relatively outwardly of said toilet but is similarly caught by said guard.

Referring now to FIG. 3 in which a perspective view of a splash and overspray guard 51 similar to the splash and overspray guard in FIGS. 1 and 2 consisting of low-tack adhesive 53*a* and 53*b* located on underside of said guard in position of use on wash basin 55 and faucet 54 and liquid pool 59*a* and adjacent surfaces including countertop 56, counter edge 57, and wall 58, which said wall may include a mirror. Splash 59 travelling relatively away from said basin and pool towards said countertop but is caught by said guard.

Referring now to FIG. 4 which is a plan view of blank 3 from which splash and overspray guard 1 is subsequently fabricated by juxtaposing overlap 4 over underlap 5 such that the edge of said overlap coincides with alignment mark 7 on said underlap and joining said underlap and said overlap by means of adhesive 6. Said guard is secured in place on the fixture to be used by affixing low-tack adhesive 8*a* and 8*b* to an appropriate background surface including a toilet seat and rear wall or mirror.

Figure 5:
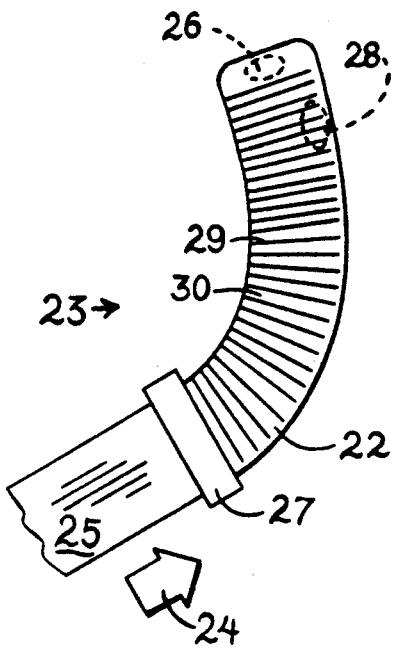
FIG. 5 is a plan view of the formation of a pleated U-shaped blank from substantially straight, flat material from which a splash and overspray guard can be fabricated for use.

Referring now to FIG. 5 which is a plan view of blank 22 which generally has a horseshoe shape cooperatively formed by creases 29 in the web, the area between lateral edges, of material 25 which said material is substantially linear, continuous, and flat, and moving in the direction of arrow 24, which creases of said material are formed and substantially selectively adhesively bonded by forming device 27 such that said creases, preferably the underside faces of which creases, form a series of pleats 30 along said blank's inner periphery producing a substantially curved, planar blank thereby. Subsequent to manufacture splash and overspray guard 23 is fabricated from said blank by juxtaposing overlap 26 over the underlapping opposite end such that the edge of said overlap coincides with an alignment mark on said underlap and adhesively joining said overlap and its opposite end or underlap. Said guard is secured in place by affixing low-tack adhesive 28, and the adhesive on the opposite end, to an appropriate background surface.

Figure 6:
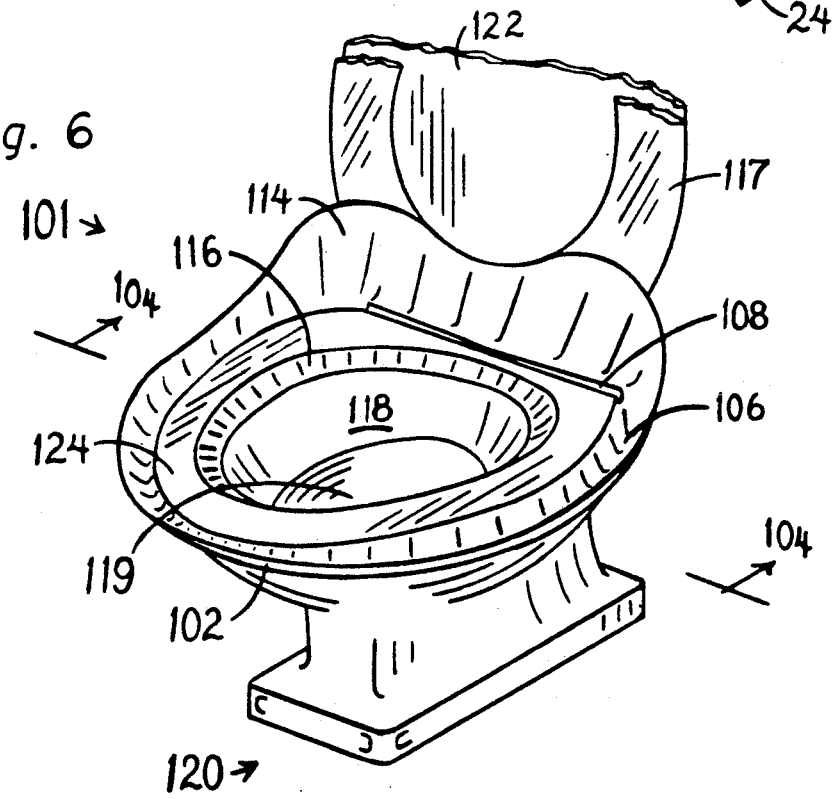
FIG. 6 is a perspective view of a molded splash and overspray guard in position for use on a toilet.

Referring now to FIG. 6 which is a perspective view of a molded splash and overspray guard 101 including outer trough wall 102, peripheral trough 106, drain groove 108, back splash 114, baffle 116, and rim cap 124. Said guard is shown in a position of use on a toilet 120, which said toilet includes toilet seat 117, bowl 118, lid 122, and bowl pool 119. Said guard is affixedly placed upon said toilet for use and said back splash is hingedly attached to said guard such that said seat may be lowered to provide seating for alternative use of said toilet without removing said guard from said toilet.

Figure 7:
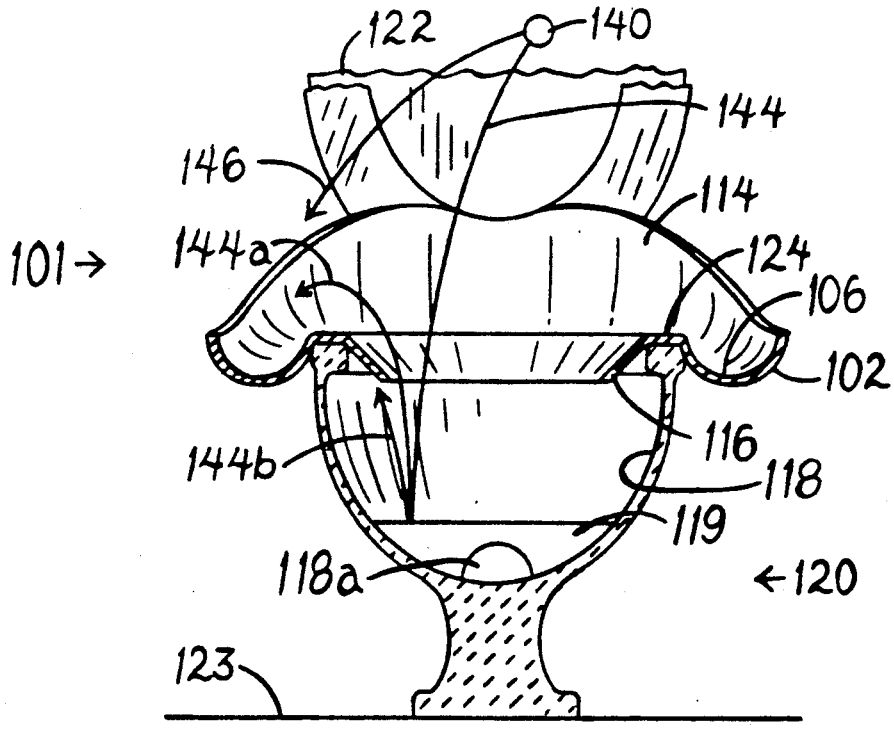
FIG. 7 is a cross-sectional elevation view of a molded splash and overspray guard.

Referring now to FIG. 7 which is a cross-sectional view of the splash and overspray guard 101 in FIG. 6 including outer trough wall 102, trough 106, back splash 114, baffle 116, rim cap 124. Said guard is shown in position for use on toilet 120 including seat, lid 122, floor surface 123, bowl 118, bowl drain 118*a*, and bowl pool 119, wherein exemplary human urine source 140 introduces accurately directed urine stream 144 into said pool which causes exemplary splash 144*a*, the trajectory or direction of which is beyond said rim but prevented from landing on adjacent surface, such as said surface 123, by said guard. Said urine stream also causes exemplary splash 144*b*, the trajectory or direction of flow of which can be seen to be towards escaping said rim but prevented by baffle 116 which is the inner underside portion of said guard. Exemplary stream 146 is misdirected over said rim but is also prevented from landing on said exemplary surface by said guard.

Many modifications and variations of subject invention are possible. For example, the contour and shape of embodiments of subject invention can be varied to depict physical features of fictitious characters which are popular among children in order to motivate their improving use of the associated fixtures. Thus, within the scope of the appended claims, the invention may be practiced differently than as described herein.

What is claimed is:

1. A portable splash guard for use on a bowl, having a rim, into which fluid waste, including waste water and urine, is directed, such as a toilet or wash basin, said splash guard including affixing means to hold said guard substantially stationary on said rim, and comprised of:

a. a trough connected to said affixing means and having a substantially U-shaped cross-section and adapted to be situated substantially exteriorly, and surround, said rim, b. a baffle connected to said affixing means and adapted to extend substantially interiorly into said bowl from said rim and extend substantially about the interior periphery of said rim, and, c. a substantially elongate member extending from said trough and adapted to extend vertically upward and posteriorly of said bowl when said guard is affixed to said bowl.

2. A splash guard according to claim 1 fabricated in a substantially moldable material.

3. A splash guard according to claim 2 in which said trough is below said rim.

4. A splash guard according to claim 3 in which a portion of said trough posteriorly situated in relation to said bowl is comparatively small and the bottom of which said trough is cambered laterally across the rear of said guard to provide laterally sloping drainage in said small trough portion.

5. A splash guard according to claim 4 in which said trough is hingedly connected to said elongate member such that, in the case that said bowl is part of a toilet, the associated toilet seat can be lowered for use without removing said guard.

* * * * *